United States Patent [19]

Mautner et al.

[11] Patent Number: 5,071,117

[45] Date of Patent: Dec. 10, 1991

[54] ELECTRIC EXERCISE APPLIANCE

[75] Inventors: Yehezkel Mautner; Eduard Mastov, both of Jerusalem, Israel

[73] Assignee: Propel Partnership 1987, Jerusalem, Israel

[21] Appl. No.: 538,578

[22] Filed: Jun. 15, 1990

[30] Foreign Application Priority Data

Jun. 15, 1989 [IL] Israel ..... 90626

[51] Int. Cl.[5] ..... A63B 23/04; A63B 69/16; A63B 21/00

[52] U.S. Cl. ..... 272/73; 272/129; 128/25 R

[58] Field of Search ..... 272/73, 129; 128/25 R

[56] References Cited

U.S. PATENT DOCUMENTS

| | | | |
|---|---|---|---|
| 2,406,344 | 8/1946 | Bergfors . | |
| 3,511,097 | 5/1970 | Corwin | 272/73 |
| 3,745,990 | 7/1973 | Neis | 272/73 |
| 3,802,698 | 3/1974 | Burian . | |
| 3,964,742 | 6/1976 | Carnielli | 272/73 |
| 3,991,749 | 11/1976 | Zent | 128/25 R |
| 4,141,248 | 1/1979 | Bargenda . | |
| 4,262,902 | 4/1981 | Dranselka | 272/73 |
| 4,298,893 | 11/1981 | Holmes | 272/73 |
| 4,673,177 | 6/1987 | Szymski | 272/73 |
| 4,717,146 | 1/1988 | Nohera | 128/25 R |
| 4,739,984 | 4/1988 | Dranselka | 272/73 |
| 4,817,939 | 4/1989 | Augspurger . | |
| 4,928,673 | 5/1990 | Heneger | 272/73 |
| 4,973,046 | 11/1990 | Maxwell | 128/75 R X |

FOREIGN PATENT DOCUMENTS

| | | | |
|---|---|---|---|
| 132504 | 5/1949 | Australia | 272/73 |
| 0215177 | 3/1987 | European Pat. Off. . | |
| 1174227 | 10/1964 | Fed. Rep. of Germany | 272/73 |
| 2054214 | 5/1971 | Fed. Rep. of Germany . | |
| 815872 | 7/1937 | France | 272/73 |
| 2198383 | 3/1974 | France . | |
| 603178 | 8/1978 | Switzerland . | |
| 611167 | 5/1979 | Switzerland . | |
| 1310408 | 3/1973 | United Kingdom . | |
| 1536655 | 12/1978 | United Kingdom . | |

*Primary Examiner*—Richard J. Apley
*Assistant Examiner*—Joe H. Cheng

[57] ABSTRACT

The invention provides an electric exercising appliance comprising a frame comprising at least one member and at least indirectly mountable on a supporting surface, an electric motor adapted to operate in a first mode in which it functions as generator, drawing muscular energy from the user of the appliance and converting the muscular energy into electrical energy convertible into other forms of energy, and in a second mode in which the motor functions as mover, drawing electrical energy from a source thereof and moving, and thereby exercising, limbs of the user, first switch for switching over from the first to the second mode and vice-versa, first adjustment switch for adjusting the energy to be expended by the user in the first mode, and second adjustment switch for adjusting the speed of the motor in the second mode.

6 Claims, 5 Drawing Sheets

ELECTRIC EXERCISE APPLIANCE

The present invention relates to an electric exercising appliance for either active or passive exercising of limb and other skeletal muscles. In this context, "active" refers to the overcoming, by the user's limbs, of a presettable resistance to movement offered by the appliance, and "passive" refers to the movement of limbs as caused by the appliance itself, acting as a mover.

Active exercising machines are well known under such names as exercising cycles, home trainers, ergometers, etc., and consist of a stationary frame including a saddle and a handlebar-like grip as well as a pair of pedals whereby the user drives a flywheel whilst overcoming a braking torque applied to the flywheel. These devices are all quite heavy and bulky: one of the better-known brands has a flywheel weighing 18 kg, with a total weight of 33 kg. This large flywheel mass is necessary so as to store up, at the relatively low flywheel speed (100–200 rmp), a sufficient amount of kinetic energy to ensure smooth pedalling. Also, for a given setting, the braking effort is far from being constant and reproducible, depending as it does on the state of wear of the braking pads and the surface condition of the flywheel faces to which the pads are applied.

None of the prior-art exercising appliances permits passive exercising, the importance of which, apart from its role in physiotherapy in general and in rehabilitative procedures in particular, is not at all well appreciated. Yet according to physiologists, periods of active exercising of muscles alternating with periods of passive exercising greatly accelerate the elimination of certain metabolic waste products of muscles, the presence of which is a major cause of muscle fatigue.

It is one of the objects of the present invention to provide an exercising appliance that is relatively inexpensive, light-weight, foldable and thus requiring very little storage space, and that, at the flip of a switch, permits either active or passive exercising.

According to the invention, this is achieved by providing an electric exercising appliance comprising a frame including at least one member and at least indirectly mountable on a supporting surface, an electric motor adapted to operate in a first mode in which it functions as generator, drawing muscular energy from the user of said appliance and converting said muscular energy into electrical energy convertible into other forms of energy, and in a second mode in which said motor functions as mover, drawing electrical energy from a source thereof and moving, and thereby exercising, limbs of said user, first switch means for switching over from said first to said second mode and vice-versa, first adjustment means for adjusting the energy to be expended by said user in said first mode, and second adjustment means for adjusting the speed of said motor in said second mode.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
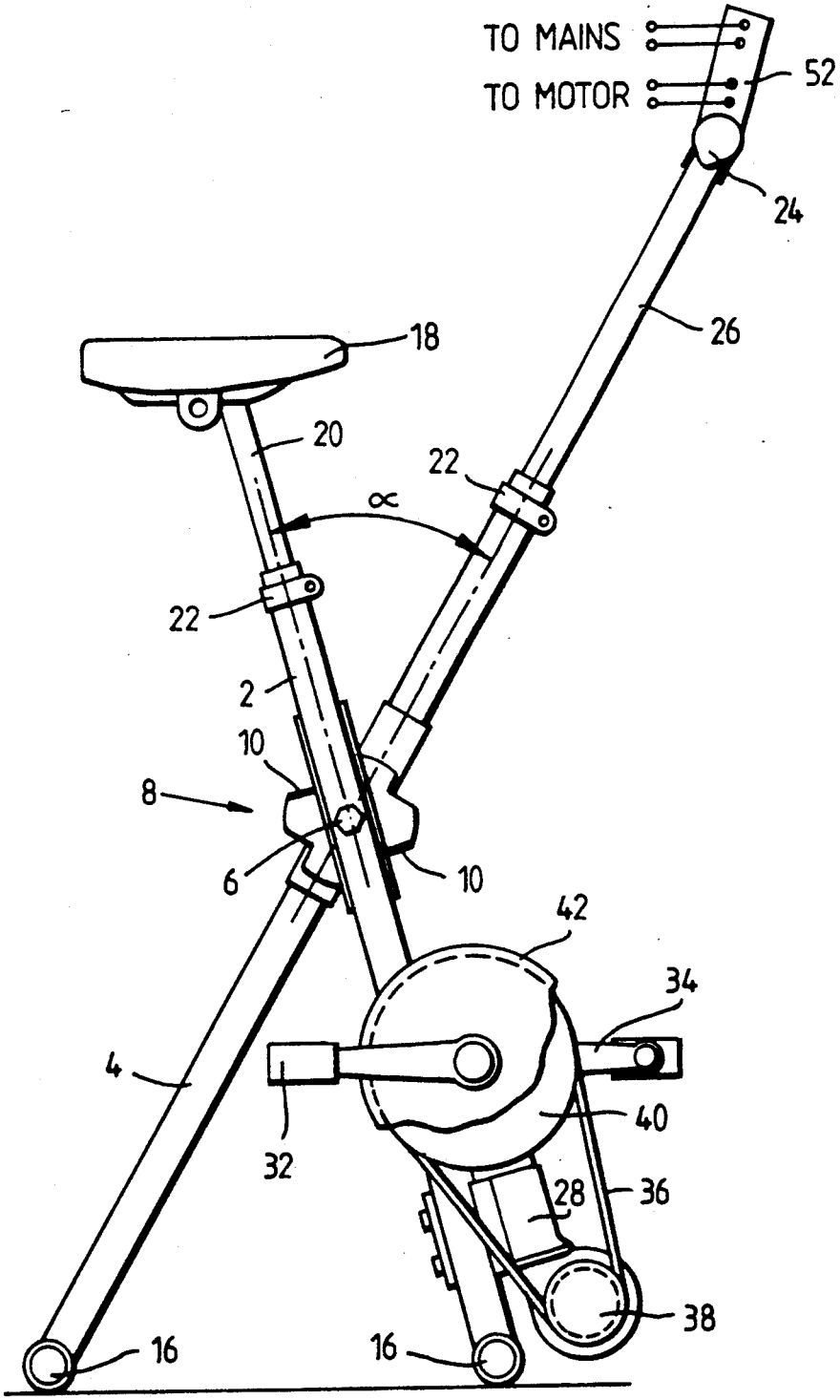
FIG. 1 is an elevational view of a first embodiment of the exercising appliance according to the invention.
Figure 2:
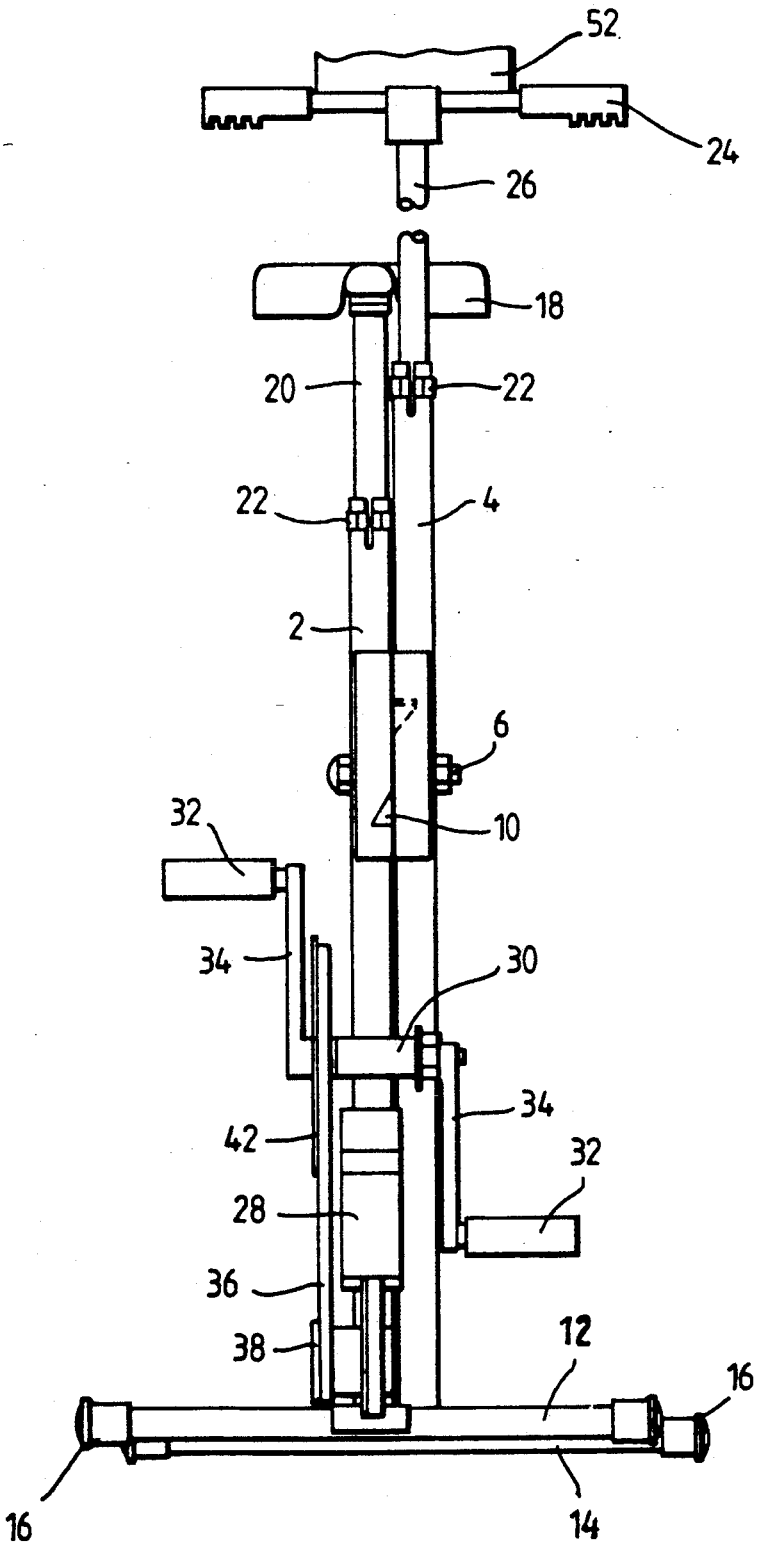
FIG. 2 shows the embodiment of FIG. 1 in front view in the folded state.

Referring now to the drawings, there are seen in FIGS. 1 and 2 two tubular frame members 2 and 4 foldably articulated to one another by means of a pivot 6 in a scissor joint 8 comprising stops 10 which define and limit the angle the two frame members 2, 4 may include in the unfolded state. When folded (for storage or transport), the two members 2, 4 are nearly parallel. At their lower ends, the members 2, 4 are provided with cross bars 12, 14, respectively, having plastic end caps 16. These cross bars constitute the feet on which the appliance rests in the unfolded state and are long enough to provide a sufficient degree of stability.

The tubular frame member 2 carries a saddle 18, the pillar 20 of which telescopically slides inside the member 2 and can be fixed at the desired position by means of a locking clamp 22. Similarly adjustable is a handlebar 24 mounted on a handlebar pillar 26 which telescopically slides in frame member 4.

Fixedly attached to the lower portion of the frame member 2 is a motor-generator 28 shown to better advantage in FIG. 3 and discussed further below.

Also fixedly attached to the frame member 2, at a point slightly above the motor 28, there is seen a pedal-axle bearing 30. As in a bicycle, the pedals 32 themselves are arranged at the ends of the cranks 34.

The drive connection between the pedals and the motor 28 is either a chain or a belt 36, which is led over a motor sprocket or pulley 38 on the one hand, and over a chain wheel or belt pulley 40, on the other. Partly shown is also a chain or pulley guard 42.

Mounted on the handlebar 24, there is seen the control panel 52, shown fully in FIG. 4 and explained further below.

Figure 3:
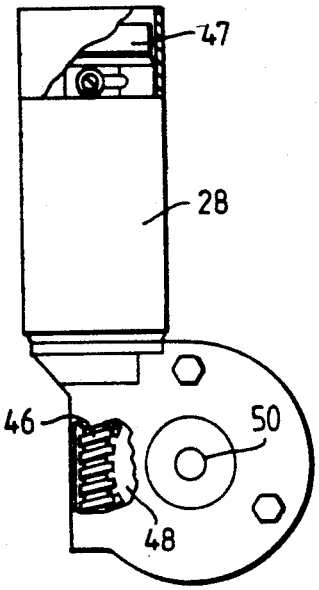
FIG. 3 illustrates the electric motor/generator and the worm gear integral therewith.

The electric motor-generator is shown in greater detail in FIG. 3. There is seen the low-voltage, permanent-magnet, d.c., motor 28, one end of the rotor shaft of which is in the form of a worm 46. On the other end of the rotor shaft there is mounted a relatively small cylindrical mass (100–200 gr) acting as flywheel 47 which, because of the very high motor speed (3000–5000 rpm) has sufficient kinetic-energy storing capacity to ensure smooth, non-jerky pedalling.

The worm 46 engages a worm wheel 48, on the output shaft 50 of which is mounted the sprocket or pulley 38 (shown in FIG. 1). The lead angle of the worm 46 is such that the motor, via the worm 46, can drive the worm wheel 48 with about the same efficiency as it can be driven by the worm wheel via the worm.

It is this feature that facilitates the use of the appliance according to the invention for both types of exercising: active and passive. In active exercising the user, via the pedals, the chain or belt 36 and the worm wheel 48 drives the motor 28, which now functions as generator. The user's muscular energy is thus turned into electrical energy by the generator, to be dissipated as heat by a variable resistor. The "braking" effect of the generator is not affected by the direction of pedalling ("forward" or "back"). Backpedalling affects a different group of muscles. Varying the above-mentioned heat-dissipating resistor varies the effort invested by the user.

In passive exercising, the motor-generator 28 operates as motor, rotating the pedals and thus moving the user's legs. Pedalling speed can be varied by varying the voltage supplied to the motor and back-pedalling is possible by throwing a switch that reverses the polarity of the d.c. voltage supplied to the motor 28. The circuit works on the a.c. mains.

Instead of being dissipated as heat, the generator output could conceivably be utilized for practical purposes such as charging a battery or operating an electric fan, or the like.

Figure 4:
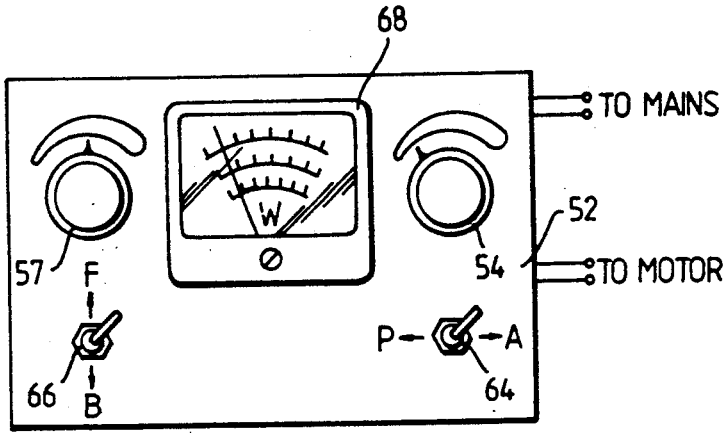
FIG. 4 represents the control panel of the appliance.
Figure 5:
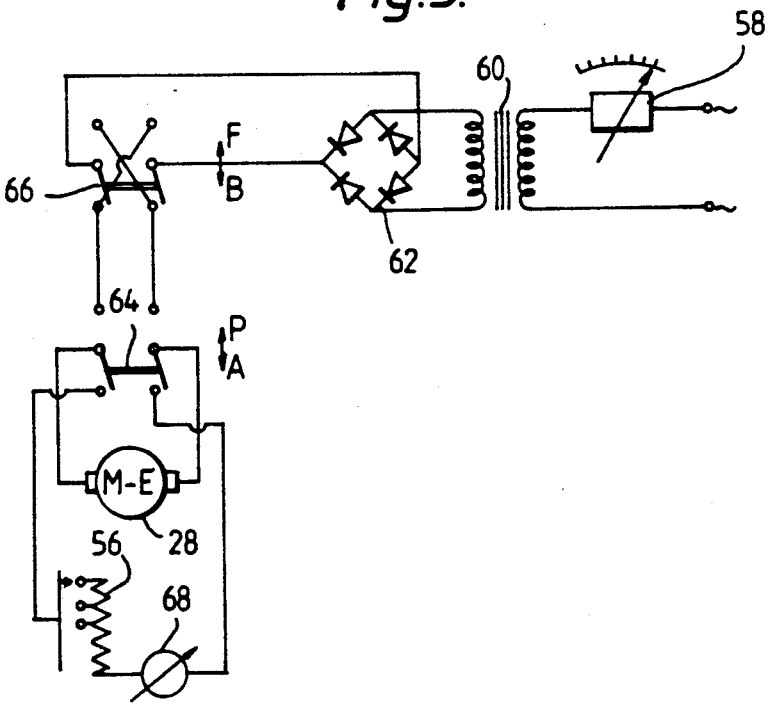
FIG. 5 shows the circuit diagram of the control panel of FIG. 4.

The control panel 52 and its electric circuit are shown in FIGS. 4 and 5, respectively. The control elements seen in FIG. 4 include two knobs, two toggle switches and one meter.

Knob 54 varies the resistor 56 that controls the "braking" effect of the generator in active exercise. Knob 57 controls the dimmer 58 that varies the primary voltage in the transformer 60 feeding the rectifier 62 that supplies the d.c. voltage to the motor in the "passive" mode.

Toggle switch 64 effects switching over from "active" (A) to "passive" (P) (in the diagram of FIG. 5, the circuit is shown in the "active" position, with the motor 28 disconnected from the voltage supply).

The polarity-changing toggle switch 66 has two positions, F for "forward" and B for "back", and determines the direction of pedalling in passive exercising.

The wattmeter 68 indicates the pedalling effort invested by the user, which, by taking into account the pedalling time, facilitates conversion into kcal expended.

Figure 6:
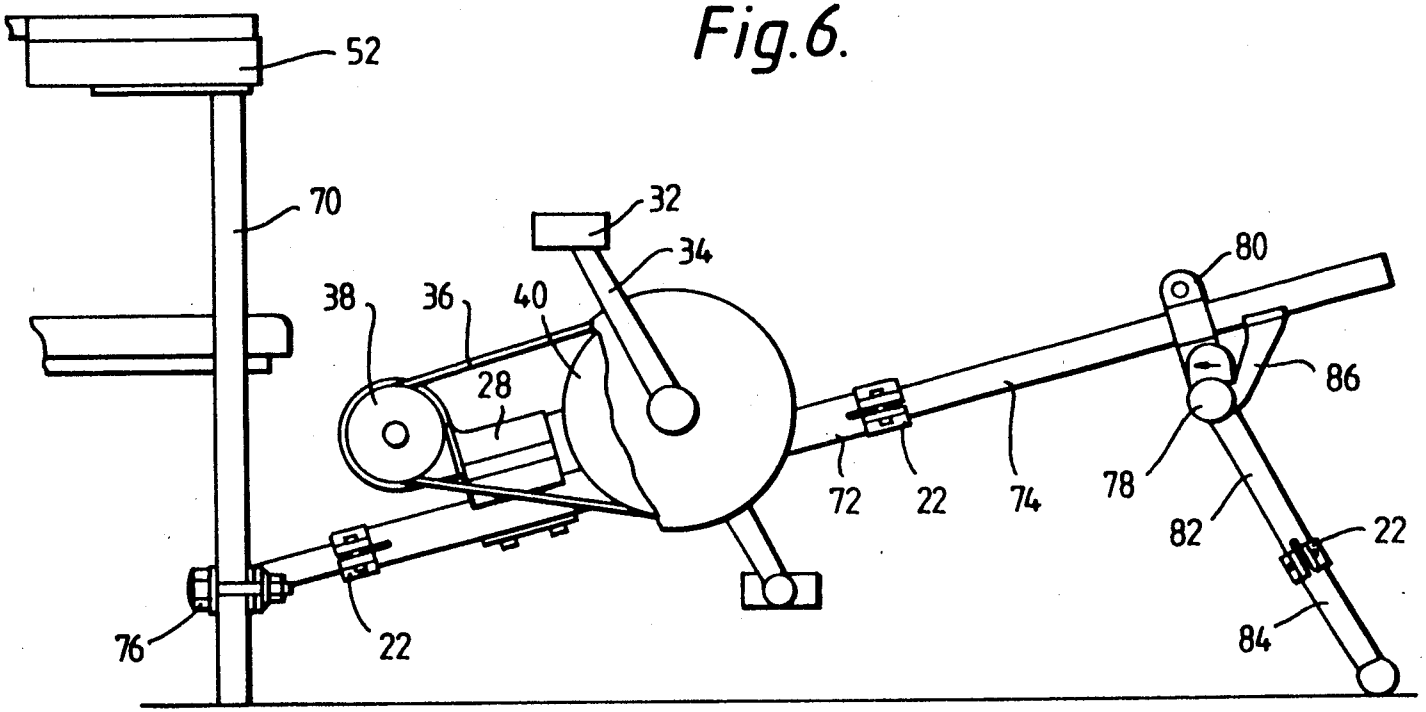
FIG. 6 illustrates another embodiment of the invention, in which one end of the frame is attached to a chair, and the other end is supported by the floor.

Another embodiment of the invention is shown in FIG. 6. Here, the appliance can be attached to the front legs of a chair 70, with armrests and backrest, permitting exercising in a comfortably seated and leaned-back position.

This embodiment has only one frame member, 72, on which are fixedly mounted the motor-generator 28 and the pedal-axle bearing 30 (not shown). The tubular member 72 rides on, and is clampable to, a bar 74, the lower end of which is provided with a cross piece having telescoping ends (not shown) attachable to the front legs of the chair 70 by means of clamps 76. An inverted-U-shaped tubular member with a horizontal base 78 (shown in the view of FIG. 6 as circle), which is attachable to the upper end portion of the bar 74 by means of a clamp 80, has two tubular limbs 82 in which telescopically slide pillars 84 that rest on the floor, thus supporting the upper end of the bar 74. A bracket 86 defines the angle between the bar 74 and the tubular limbs 82. Clamps 22 immobolize the telescoping pillars 84 after their position (which determines the inclination of the bar 74) has been adjusted.

The control panel 52 is conveniently attached to one of the armrests of the chair 70. The position of the member 72 along the bar 74, as well as the inclination of the latter are adjusted according to the requirements of the individual user.

Figure 7:
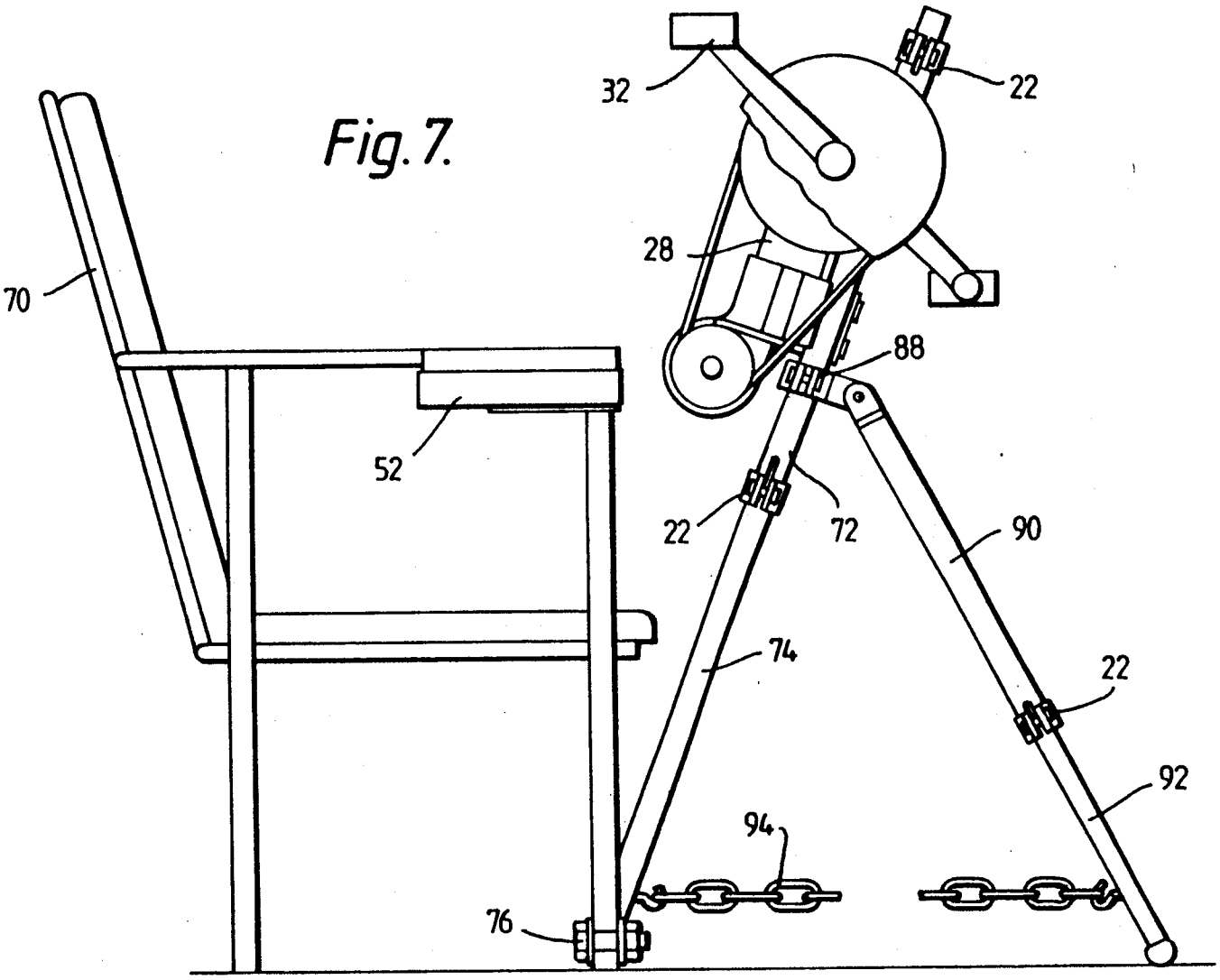
FIG. 7 is still another embodiment attached to a chair, but intended for exercising the arms.

The embodiment represented in FIG. 7 illustrates the use of the appliance according to the invention as arranged for exercising the arm and associated muscles. This variant, too, is attachable to the front legs of a chair. The frame member 72 and bar 74 are the same as in the embodiment of FIG. 6, as are the telescoping ends of the cross piece (not shown) and the clamps 76. In addition, there is seen another clamp 88, attachable to the frame member 72, to which clamp is hingedly attached a tubular member 90 accommodating a telescoping pillar 92. The latter is provided with a cross piece (not shown) having two plastic end caps 16 in the manner of the cross bars 12 or 14 of FIG. 1. Pillar 92 is immobilized by means of a clamp 22.

The vertical height of the pedal axis relative to the seat of the chair is adjusted by lowering or raising the frame member 72, while the horizontal distance of the pedal axis relative to the edge of the seat is adjusted by varying the inclination of the bar 74 by adjusting the effective length of the telescoping pillar 92. A chain 94 limits the angle included between the bar 74 and the pillar 92.

Using the same pedal pins, the standard pedals 32 are advantageously replaced by substantially cylindrical handles easily gripped by the user's hands.

Optional attachments to the exercising appliance according to the invention may include a timer producing an acoustic or optical signal after a presettable time interval has elapsed, and a tachometer or a stroboscopic disk (to be used with fluorescent lighting) as a pace setter.

The exercise appliance may also include a programmer to control the resistance range. Accordingly, one would be able to regulate physical effort and, particularly, to keep load constant independent of pedalling speed.

While a worm drive as described in the most convenient, efficient and space-saving solution to the problems defined (drivability in both directions), it would also be possible to use a gear transmission of the conventional type.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An electric exercising appliance comprising:

a frame comprising at least one member and at least indirectly mountable on a supporting surface;

an electric motor adapted to operate in a first mode in which it functions as generator, drawing muscular energy from the user of said appliance and converting said muscular energy into electrical energy convertible into other forms of energy, and in a second mode in which said motor functions as mover, drawing electric energy from a source thereof and moving, and thereby exercising, limbs of said user;

first switch means for switching over from said first mode to said second mode and vice versa;

first adjustment means for adjusting the energy to be expended by said user in said first mode;

second adjustment means for adjusting the speed of said motor in said second mode;

flywheel means directly and fixedly attached to one end of the rotor of said motor, the other end of said motor being connected with an integral speed reducing means; and pedals means connected to said speed reducing means for being moved by, or moving, limbs of said user.

2. The appliance as claimed in claim 1, wherein said frame is foldable and comprises two tubular members articulated to one another.

3. The appliance as claimed in claim 1, wherein said frame is attachable to at least some legs of a chair.

4. The appliance as claimed in claim 1, wherein said motor is a d.c. motor, and wherein said speed reducing means is a worm gear comprising a worm and worm wheel, said worm having a lead angle such that said motor, via said worm, can drive said worm wheel with substantially the same efficiency as it can be driven by said worm wheel via said worm.

5. The appliance as claimed in claim 1, further comprising second switch means for reversing the sense of rotation of said motor in said second mode of operation.

6. The appliance as claimed in claim 1, further comprising a wattmeter for measuring the energy expended in pedalling per unit time.

* * * * *

UNITED STATES PATENT AND TRADEMARK OFFICE

CERTIFICATE OF CORRECTION

PATENT NO. : 5,071,117

DATED : Dec. 10, 1991

INVENTOR(S) : Yehezkel Mautner; Eduard Mastov

It is certified that error appears in the above-identified patent and that said Letters Patent is hereby corrected as shown below:

In column 5, line 12, "motor" should read "rotor"

Signed and Sealed this

Twenty-fourth Day of August, 1993

Bruce Lehman

*Attest:*

BRUCE LEHMAN

*Attesting Officer*

*Commissioner of Patents and Trademarks*